US006417830B1

(12) United States Patent
Byeon, II

(10) Patent No.: US 6,417,830 B1
(45) Date of Patent: Jul. 9, 2002

(54) APPARATUS AND METHODS FOR LOW-POWER DRIVING OF A LIQUID CRYSTAL DISPLAY DEVICE

(75) Inventor: Jae Byeon, II, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/185,475

(22) Filed: Nov. 3, 1998

(30) Foreign Application Priority Data

Apr. 20, 1998 (KR) ..... 98-14069

(51) Int. Cl.[7] ..... G09G 3/36
(52) U.S. Cl. ..... 345/99; 345/94; 345/100
(58) Field of Search ..... 345/94–100, 208, 345/209, 210

(56) References Cited

U.S. PATENT DOCUMENTS 5,049,865 A * 9/1991 Nakamura et al. ..... 340/204
5,315,315 A * 5/1994 Nakamura ..... 345/208
5,748,165 A * 5/1998 Kubota et al. ..... 345/96
5,793,346 A 8/1998 Moon ..... 345/92
5,867,141 A * 2/1999 Asada et al. ..... 345/100

* cited by examiner

*Primary Examiner*—Bipin Shalwala
*Assistant Examiner*—David L. Lewis
(74) *Attorney, Agent, or Firm*—Myers Bigel Sibley & Sajovec

(57) ABSTRACT

An apparatus is provided for driving a liquid crystal display (LCD) device including an array of LCD elements arranged in rows and columns, a respective row of LCD elements connected to a respective gate line, a respective column of LCD elements connected to a respective source line. A gate driver circuit is configured to connect to the gate lines of the LCD device and operative to simultaneously drive a group of gate lines during a first time period to thereby transfer charge between the rows of LCD elements connected to the group of gate lines and operative to drive a selected one gate line of the group of gate lines during a second time period. A source driver circuit is configured to connect to the source lines of the LCD device and operative to apply a video voltage to a source line connected to an LCD element in the row of LCD elements connected to the selected one gate line during the second time period. Related operating methods are also described.

13 Claims, 4 Drawing Sheets

APPARATUS AND METHODS FOR LOW-POWER DRIVING OF A LIQUID CRYSTAL DISPLAY DEVICE

FIELD OF THE INVENTION

The present invention relates to display devices and methods of operation therefor, and more particularly, to liquid crystal display (LCD) devices and methods of operation therefor.

BACKGROUND OF THE INVENTION

Liquid crystal display (LCD) devices are used in a wide variety of consumer products such as portable game machines, portable computers and the like. A typical LCD comprises a panel including an array of LCD elements arranged in rows and columns. A respective LCD element includes a liquid crystal element that transmits light according to a voltage applied thereto. A color filter may be included to preferentially transmit a selected color, e.g., red, blue or green. In an active-matrix LCD element, a thin-film-transistor is used to control voltage applied to the liquid crystal element. The gates of a row of LCD elements are typically connected to a common gate line, while the source electrodes of a column of LCD elements are typically connected to a common source line that provides a video voltage.

The gate lines control application of the video voltages supplied by the source lines to the liquid crystal elements, typically using a sequential line scan. To scan a line, a gate line for a selected row of LCD elements is driven to select a row of the display, and a video voltage is supplied to each column of the selected row through a source driver. The polarity of voltages applied to the liquid crystal elements typically is periodically reversed to extend the life of the display by preventing migration of the liquid crystal material toward one direction.

One technique for applying voltages to a liquid crystal element involves controlling the voltage at both electrodes of the element, as illustrated in FIG. 1. During a first time period a and a second time period b, the element turns white as a voltage difference between a first electrode and a second electrode of the liquid crystal element is relatively low. The element turns black during a third time period c, a fourth time period d, and a fifth time period e, when the voltage difference is increased. For the technique illustrated, the change in voltage applied to an electrode between periods is relatively small. However, as the voltage applied to both electrodes of the liquid crystal element is controlled, the driver design may be complex and it may be difficult to maintain picture quality.

An alternative driving technique is illustrated in FIG. 2. According to this technique, a first one of the electrodes of the liquid crystal element is held at a constant reference voltage while a voltage applied to a second electrode is varied. Although this technique can produce superior picture quality, large positive and negative voltage swings can occur on the non-constant electrode. These large swings can cause delay in reaching the desired voltage amplitude and can increase power dissipation in the output driver that drives the liquid crystal element.

SUMMARY OF THE INVENTION

In light of the foregoing, it is an object of the present invention to provide methods and apparatus for driving liquid crystal displays (LCDs) that can provide decreased power dissipation.

This and other objects, features and advantage are provided according to the present invention by apparatus and methods for driving an LCD in which a group of gate lines, e.g., adjacent gate lines, are driven during a first time period to thereby cause a charge transfer between liquid crystal elements associated with the driven gate lines, and then all but one of the group of gate lines is deactivated during a succeeding second time period as a video voltage is applied to the liquid crystal element controlled by the remaining active gate line. The charge-sharing that occurs between liquid crystal elements during the first time period allows the voltages on the liquid crystal elements activated by the group of gate lines to float toward a medial value, reducing the amount of voltage swing that occurs during the second time period.

In particular, according to the present invention, an apparatus is provided for driving a liquid crystal display (LCD) device including an array of LCD elements arranged in rows and columns, a respective row of LCD elements connected to a respective gate line, and a respective column of LCD elements connected to a respective source line. A gate driver circuit is configured to connect to the gate lines of the LCD device and operative to simultaneously drive a group of gate lines during a first time period to thereby transfer charge between the rows of LCD elements connected to the group of gate lines. The gate driver circuit is also operative to drive a selected one gate line of the group of gate lines during a second time period. A source driver circuit is configured to connect to the source lines of the LCD device and operative to apply a video voltage to a source line connected to an LCD element in the row of LCD elements connected to the selected one gate line during the second time period.

In an embodiment according to the present invention, the gate driver circuit is operative to simultaneously drive a first gate line connected to a first row of LCD elements and a second gate line connected to a second row of LCD elements during the first time period. The gate driver circuit is operative to drive the first gate line during the second time period. The gate driver circuit is operative to simultaneously drive the second gate line and a third gate line connected to a third row of LCD element during a third time period following the second period. The gate driver circuit is operative to drive the second gate line during a fourth time period following the third time period. The source driver circuit is operative to apply a first video voltage to a source line connected to an LCD element of the first row of LCD elements during the second time period, and the source driver circuit is operative to apply a second video voltage to a source line connected to an element of the second row of LCD elements during the fourth time period.

According to method aspects of the present invention, a liquid crystal display (LCD) device is operated by simultaneously driving a group of gate lines during a first time period to thereby transfer charge between the rows of LCD elements connected to the group of gate lines. A selected one gate line of the group of gate lines is then driven while applying a video voltage to a source line connected to an LCD element in a row of LCD elements connected to the selected one gate line during a second time period. Improved operation of an LCD device is thereby provided.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As will be appreciated by one of skill in the art, the present invention may be embodied as methods or devices.

Figure 1:
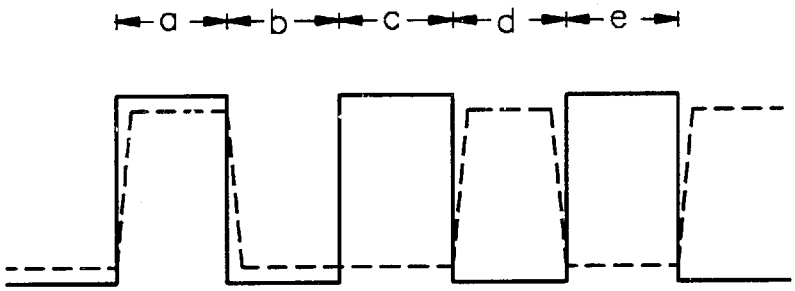
FIG. 1 (PRIOR ART)
FIGS. 1 and 2 illustrate conventional LCD device driving techniques.
Figure 2:
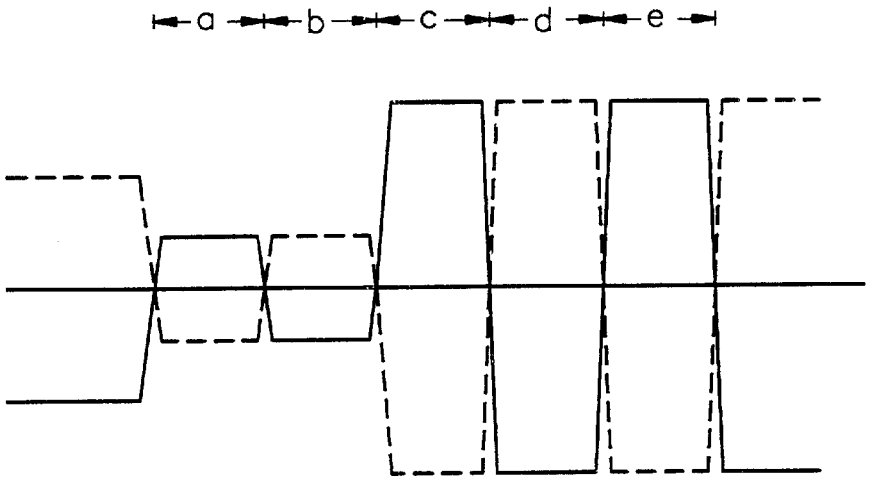
FIG. 2 (PRIOR ART)
Figure 3:
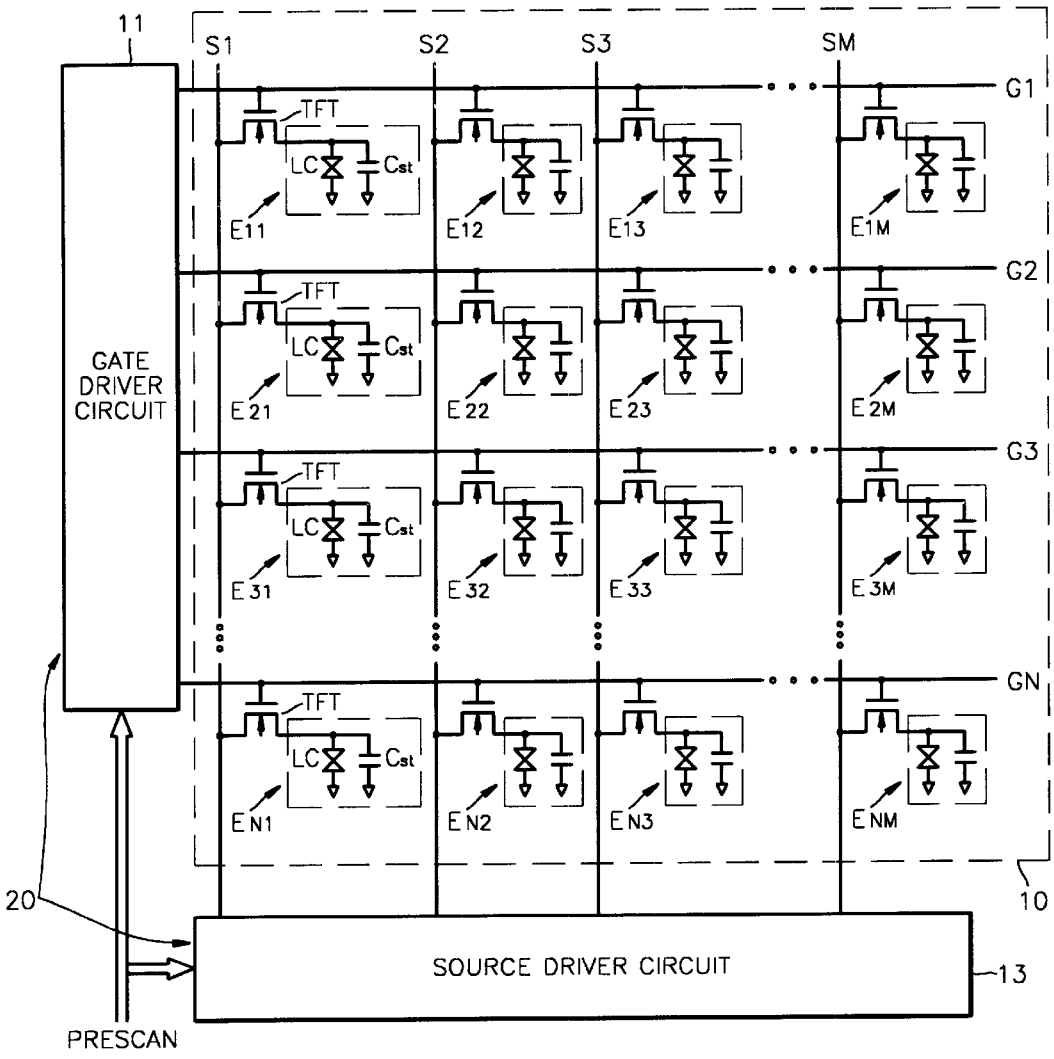
FIG. 3 is a schematic diagram illustrating a low power driving circuit according to the present invention.

FIG. 3 illustrates an embodiment of an apparatus 20 for driving a liquid crystal display (LCD) device 10. The LCD device 10 includes an N×M array of LCD elements $E_{11}$–$E_{NM}$. A respective one of the elements $E_{11}$–$E_{MN}$ includes a respective liquid crystal element LC and a respective storage capacitor $C_{st}$. The liquid crystal elements LC and the storage capacitors $C_{st}$ form capacitances $C_{11}$–$C_{NM}$, a respective one of which is connected to a drain electrode of a respective thin-film transistor TFT. The source electrodes of the thin-film transistors TFT of a respective column of LCD elements are connected to a respective one of a plurality of source lines S1–SM, while the gate electrodes of the thin-film transistors TFT of a respective row of LCD elements are connected to a respective one of a plurality of gate lines G1–GN.

The driving apparatus 20 includes a gate driver circuit 11 connected to the plurality of gate lines G1–GM, and a source driver circuit 13 connected to the plurality of source lines S1–SM. The gate driver circuit 11 and the source driver circuit 13 are responsive to a control signal PRESCAN in a manner described in greater detail below.

Figure 6:
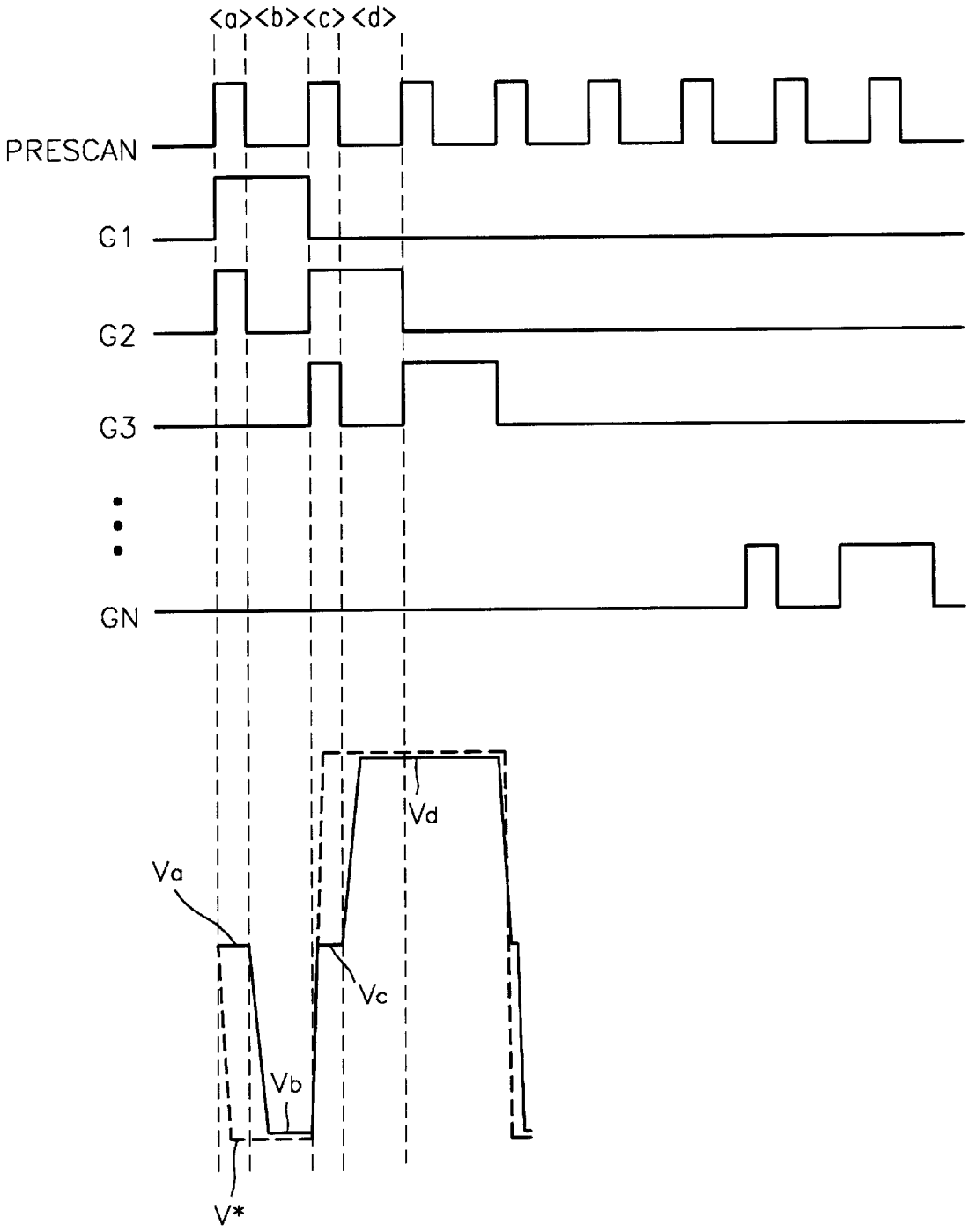
FIG. 6 is a timing diagram illustrating exemplary operations for driving an LCD device according to an aspect of the present invention.

Referring to FIG. 6, a driving sequence is applied to the gate lines G1–GN responsive to the control signal PRESCAN such that a first gate GI and a second gate line G2 are driven simultaneously during a first time period a while the source driver circuit 13 provides a high impedance to the source lines S1–SM. During this first time period a, charge is shared between the LCD elements of the rows of LCD elements connected to the first and second gate lines G1, G2, producing a voltage $V_a$. on a source line $S_i$. During a second time period b following the first time period a, the second gate line G2 is deactivated while the first gate line remains driven and a video voltage is applied to a source line $S_i$ connected to an LCD element of the row of LCD elements connected to the first gate line G1, producing a voltage $V_b$ on the source line $S_i$. During a third time period c following the second time period b, second and third gate lines G2, G3 are simultaneously driven while the source driver circuit 13 provides a high impedance to the source lines S1–SM, causing a charge sharing between rows of LCD elements connected to the second and third gate lines G2, G3 and producing a voltage $V_c$ on the source line $S_i$. During a fourth time period d following the third time period c, the third gate line G3 is deactivated while the second gate line G2 is driven and a video voltage is applied to the source line $S_I$, producing a voltage $V_d$ on the source line $S_i$. This process proceeds in a similar fashion as the array of LCD elements is sequentially scanned. When compared to a source line voltage V* produced according to a conventional techniques, it can be seen that the source line voltage $V_a$, $V_b$, $V_c$, $V_d$ produced according to the present invention changes in a stepped fashion, with a reduced slew rate.

Figure 4:
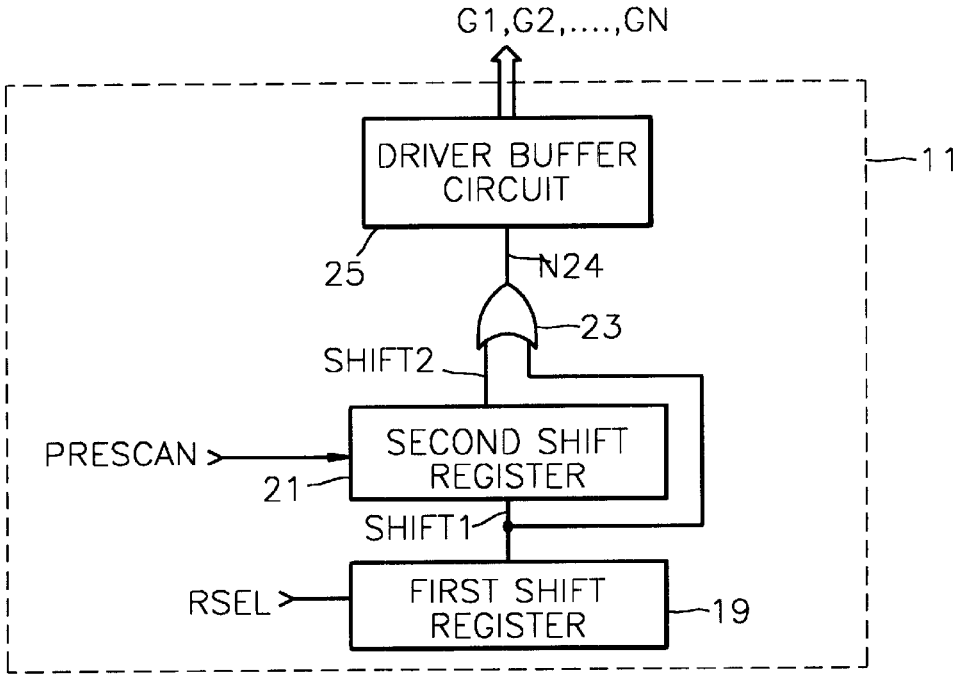
FIG. 4 illustrates a gate driver circuit according to an embodiment of the present invention.

FIG. 4 illustrates an embodiment of a gate driver circuit 11. A first shift register 19 receives a gate line select input RSEL and produces a gate line select output SHIFT1, e.g., a multi-bit digital output having one bit with a different logical value (corresponding to the desired gate line) than the other bits. A second shift register 21 receives the first gate line select output SHIFT1 and produces a second gate line select output SHIFT2 that shifts in response to the control signal PRESCAN. The first gate line select output SHIFT1 and the second gate line select output SHIFT2 are logically OR'ed by logic circuit 23 to produce a third gate line select output N24. The third gate line select output N24 is applied to a driver buffer circuit 25 that drives the gate lines G1–GN of the LCD device 10 of FIG. 3.

In operation, the first and second shift registers 19, 21 produce identical first and second a gate line select outputs SHIFT1, SHIFT2 upon assertion of the gate line select input RSEL, thus driving a selected one of the gate lines G1–GN via action of the logic circuit 23. Upon a next transition of the control signal PRESCAN, the second shift register shifts the second gate select output SHIFT2 one bit, thus producing a third gate line select signal N24 that drives two adjacent gate lines of the gate lines G1–GN.

Figure 5:
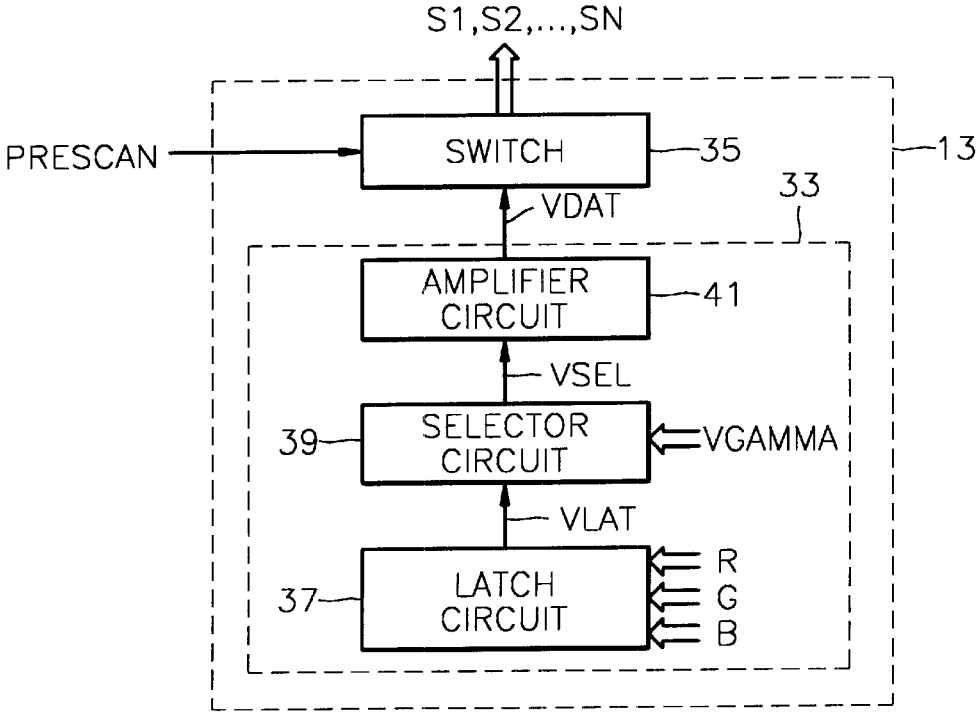
FIG. 5 illustrates a source driver circuit according to an embodiment of the present invention.

FIG. 5 illustrates an embodiment of a source driver circuit 13. In response to the control signal PRESCAN, the source driver circuit 13 provides a high impedance to the source lines S1–SN while multiple gate lines are simultaneously driven during a first time period, as described above. During a succeeding second time period, the source driver circuit applies video voltages to the source lines S1–SN to scan a selected row of the display.

A video voltage generator circuit 33 generates amplified video voltages VDAT that are supplied to a switch 35. The video voltage generator circuit 33 includes a latch circuit 37 that is operative to store video data R,G,B supplied thereto. A selector circuit 39 is operative to produce a video voltage VLAT corresponding to a video datum stored in the latch circuit 37 responsive to a data select signal VGAMMA. An amplifier circuit 41 amplifies the video voltage VLAT to produce an amplified video voltage VDAT. The switch 35 selectively applies the amplified video voltage VDAT to the source lines S1–SM or provides a high impedance to the source lines S1-SM responsive to the control signal PRESCAN.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An apparatus for driving a liquid crystal display (LCD) device, the LCD device including an array of LCD elements arranged in rows and columns, a respective row of LCD elements connected to a respective gate line, a respective column of LCD elements connected to a respective source line, the apparatus comprising:

a gate driver circuit configured to connect to the gate lines of the LCD device, operative to simultaneously drive a group of gate lines during a first time period to thereby transfer charge between the rows of LCD elements connected to the group of gate lines, and operative to drive a selected one gate line of the group of gate lines during a second time period following the first time period; and a source driver circuit configured to connect to the source lines of the LCD device and operative to apply a video voltage to a source line connected to an LCD element in the row of LCD elements connected to the selected one gate line during the second time period.

2. An apparatus according to claim 1, wherein said gate driver circuit is operative to simultaneously drive a group of gate lines connected to adjacent rows of LCD elements during the first time period.

3. An apparatus for driving a liquid crystal display (LCD) device, the LCD device including an array of LCD elements arranged in rows and columns, a respective row of LCD elements connected to a respective gate line, a respective column of LCD elements connected to a respective source line, the apparatus comprising:

a gate driver circuit configured to connect to the gate lines of the LCD device, operative to simultaneously drive a group of gate lines during a first time period to thereby transfer charge between the rows of LCD elements connected to the group of gate lines, and operative to drive a selected one gate line of the group of gate lines during a second time period following the first time period; and a source driver circuit configured to connect to the source lines of the LCD device and operative to apply a video voltage to a source line connected to an LCD element in the row of LCD elements connected to the selected one gate line during the second time period;

wherein said gate driver circuit is operative to simultaneously drive a first gate line connected to a first row of LCD elements and a second gate line connected to a second row of LCD elements during the first time period, wherein said gate driver circuit is operative to drive the first gate line during the second time period, wherein said gate driver circuit is operative to simultaneously drive the second gate line and a third gate line connected to a third row of LCD element during a third time period following the second period, and wherein said gate driver circuit is operative to drive the second gate line during a fourth time period following the third time period; and wherein said source driver circuit is operative to apply a first video voltage to a source line connected to an LCD element of the first row of LCD elements during the second time period, and wherein said source driver circuit is operative to apply a second video voltage to a source line connected to an element of the second row of LCD elements during the fourth time period.

4. An apparatus for driving a liquid crystal display (LCD) device, the LCD device including an array of LCD elements arranged in rows and columns, a respective row of LCD elements connected to a respective gate line, a respective column of LCD elements connected to a respective source line, the apparatus comprising:

a gate driver circuit configured to connect to the gate lines of the LCD device, operative to simultaneously drive a group of gate lines during a first time period to thereby transfer charge between the rows of LCD elements connected to the group of gate lines, and operative to drive a selected one gate line of the group of gate lines during a second time period following the first time period; and a source driver circuit configured to connect to the source lines of the LCD device and operative to apply a video voltage to a source line connected to an LCD element in the row of LCD elements connected to the selected one gate line during the second time period;

wherein said gate driver circuit comprises:

a first shift register operative to produce a first gate line select output that shifts in response to a first control signal;

a second shift register, responsive to said first shift register and operative to load said first gate line select output and to produce a second gate line select output that shifts in response to a second control signal;

a logic circuit configured to receive the first gate line select output and the second gate line select output and operative to produce a third gate line select output that represents a logical OR of the first gate line select output and the second gate line select output; and a buffer driver circuit, configured to connect to the gate lines of the LCD device and operative to receive the third gate line select output and to drive the gate lines of the LCD device in response thereto.

5. An apparatus according to claim 1, wherein said source driver circuit is operative to provide a high impedance to the source lines of the LCD device while the group of gate lines is simultaneously driven during the first time period.

6. An apparatus according to claim 5, wherein said source driver circuit comprises:

a video voltage generator circuit operative to generate a video voltage; and a switch, configured to connect to the source lines of the LCD device, responsive to said video voltage generator and to a control signal and operative to provide a high impedance to the source lines of the LCD driving voltage during the first time period and to supply the generated video voltage to a source line connected to an LCD element of the selected one row of LCD elements during the second time period.

7. An apparatus according to claim 6, wherein said video voltage generator circuit comprises:

a latch circuit operative to store video data;

a selector circuit, responsive to the latch and operative to produce a video signal corresponding to a video datum stored in said latch in response to a data select signal; and an amplifier circuit operative to produce an amplified video signal from the video signal.

8. An apparatus for driving a liquid crystal display (LCD) device, the LCD device including an array of LCD elements arranged in rows and columns, a respective row of LCD elements connected to a respective gate line, a respective column of LCD elements connected to a respective source line, the apparatus comprising:

gate driving means, configured to connect to said gate lines, for simultaneously driving a group of gate lines during a first time period to thereby transfer charge between the rows of LCD elements connected to the group of gate lines and for then driving a selected one gate line of the group of gate lines during a second time period; and source driving means, configured to connect to said source lines, for applying a video voltage to a source line connected to an LCD element in the row of LCD elements connected to the selected one gate line during the second time period.

9. An apparatus according to claim 8, wherein said gate driving means comprise means for simultaneously driving a group of gate lines connected to adjacent rows of LCD elements during the first time period.

10. An apparatus for driving a liquid crystal display (LCD) device, the LCD device including an array of LCD elements arranged in rows and columns, a respective row of LCD elements connected to a respective gate line, a respective column of LCD elements connected to a respective source line, the apparatus comprising:

gate driving means, configured to connect to said gate lines, for simultaneously driving a group of gate lines during a first time period to thereby transfer charge between the rows of LCD elements connected to the group of gate lines and for then driving a selected one gate line of the group of gate lines during a second time period; and source driving means, configured to connect to said source lines, for applying a video voltage to a source line connected to an LCD element in the row of LCD elements connected to the selected one gate line during the second time period;

wherein said gate driving means comprises:

means for simultaneously driving a first gate line connected to a first row of LCD elements and a second gate line connected to a second row of LCD elements during the first time period;

means for driving the first gate line during the second time period;

means for simultaneously driving the second gate line and a third gate line connected to a third row of LCD elements during a third time period following the second period; and means for driving the second gate line during a fourth time period following the third time period; and wherein said source driving means comprises:

means for driving a source line connected to an LCD element of the first row of LCD elements during the second time period; and means for driving a source line connected to an LCD element of the second row of LCD elements during the fourth time period.

11. A method of operating a liquid crystal display (LCD) device, the LCD device including an array of LCD elements arranged in rows and columns, a respective row of LCD elements being connected to a respective gate line, a respective column of LCD elements being connected to a respective source line, the method comprising the steps of:

simultaneously driving a group of gate lines during a first time period to thereby transfer charge between the rows of LCD elements connected to the group of gate lines; and then driving a selected one gate line of the group of gate lines while applying a video voltage to a source line connected to an LCD element in a row of LCD elements connected to the selected one gate line during a second time period.

12. A method according to claim 11, wherein said step of simultaneously driving comprises the step of driving a group of gate lines connected to adjacent rows of LCD elements during the first time period.

13. A method of operating a liquid crystal display (LCD) device, the LCD device including an array of LCD elements arranged in rows and columns, a respective row of LCD elements being connected to a respective gate line, a respective column of LCD elements being connected to a respective source line, the method comprising the steps of:

simultaneously driving a group of gate lines during a first time period to thereby transfer charge between the rows of LCD elements connected to the group of gate lines; and then driving a selected one gate line of the group of gate lines while applying a video voltage to a source line connected to an LCD element in a row of LCD elements connected to the selected one gate line during a second time period;

wherein said step of simultaneously driving comprises the step of simultaneously driving a first gate line connected to a first row of LCD elements and a second gate line connected to a second row of LCD elements during the first time period, wherein said step of driving a selected one gate line comprises the step of driving the first gate line while applying a video voltage to a source line connected to an LCD element of the first row of LCD elements during the second time period, and further comprising the steps of:

simultaneously driving the second gate line and a third gate line connected to a third row of LCD element during a third time period following the second period; and then driving the second gate line while applying a video voltage to a source line connected to an LCD element of the second row of LCD elements during a fourth time period.

* * * * *